US007671537B2

(12) United States Patent
Geijtenbeek et al.

(10) Patent No.: US 7,671,537 B2
(45) Date of Patent: Mar. 2, 2010

(54) METAL HALIDE LAMP

(75) Inventors: Johannes Jacobus Franciscus Geijtenbeek, Eindhoven (NL); Antonius Arnoldus Duisters, Eindhoven (NL); Theodorus Gerardus Marinus Maria Kappen, Eindhoven (NL); Joseph Leonardus Gregorius Suijker, Eindhoven (NL); Vincent Marco Fischer, Eindhoven (NL); Gerardus Marinus Josephus Franciscus Luijks, Eindhoven (NL); Hendrik Anton Van Esveld, Eindhoven (NL); Vital Louis Elisabeth Bruyndoncx, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 365 days.

(21) Appl. No.: 10/598,263

(22) PCT Filed: Mar. 1, 2005

(86) PCT No.: PCT/IB2005/050746

§ 371 (c)(1),
(2), (4) Date: Aug. 23, 2006

(87) PCT Pub. No.: WO2005/088675

PCT Pub. Date: Sep. 22, 2005

(65) Prior Publication Data

US 2008/0278077 A1 Nov. 13, 2008

(30) Foreign Application Priority Data

| | | |
|---|---|---|
| Mar. 8, 2004 | (EP) | 04100921 |
| Mar. 8, 2004 | (EP) | 04100924 |
| Apr. 16, 2004 | (EP) | 04101583 |

(51) Int. Cl.
*H01J 61/20* (2006.01)

(52) U.S. Cl. ..... 313/640; 445/46

(58) Field of Classification Search ..... 313/567, 313/634, 636–643; 445/9, 16, 18, 22, 5, 445/11, 14, 15, 21, 23, 26, 27, 33, 38, 62, 445/65, 66, 67, 73
See application file for complete search history.

(56) References Cited

U.S. PATENT DOCUMENTS

| | | | | |
|---|---|---|---|---|
| 6,198,223 | B1 * | 3/2001 | Scholz | 313/623 |
| 6,469,446 | B1 | 10/2002 | Stockwald | |
| 6,536,918 | B1 | 3/2003 | Boroczki et al. | |
| 6,639,341 | B1 * | 10/2003 | Sakai et al. | 313/25 |
| 6,731,068 | B2 * | 5/2004 | Dakin et al. | 313/640 |
| 6,731,069 | B1 * | 5/2004 | Newell et al. | 313/643 |
| 6,819,050 | B1 * | 11/2004 | Zhu et al. | 313/639 |

(Continued)

FOREIGN PATENT DOCUMENTS

| | | | |
|---|---|---|---|
| EP | 0587238 | A1 | 3/1994 |

(Continued)

*Primary Examiner*—Toan Ton
*Assistant Examiner*—Brenitra M Lee

(57) ABSTRACT

A metal halide lamp includes a discharge vessel surrounded by an outer envelope with clearance and has a ceramic wall which encloses a discharge space filled with a filling comprising an inert gas, such as xenon (Xe), and an ionizable salt. In the discharge space, two electrodes are arranged whose tips have a mutual interspacing so as to define a discharge path between them. The ionizable salt comprises NaI, TlI, $CaI_2$ and X-iodide wherein X is selected from the group comprising rare earth metals.

19 Claims, 2 Drawing Sheets

U.S. PATENT DOCUMENTS

| | | | | |
|---|---|---|---|---|
| 6,861,805 | B2 * | 3/2005 | Jackson et al. | 313/607 |
| 6,946,797 | B2 * | 9/2005 | Eisemann | 313/640 |
| 2003/0102808 | A1 | 6/2003 | Dakin et al. | |
| 2005/0093455 | A1 * | 5/2005 | Tamura et al. | 313/638 |
| 2005/0122047 | A1 * | 6/2005 | Kato et al. | 313/631 |

FOREIGN PATENT DOCUMENTS

| | | | |
|---|---|---|---|
| WO | WO9953522 | A1 | 10/1999 |
| WO | WO9953523 | A1 | 10/1999 |
| WO | WO02091428 | A2 | 11/2002 |

* cited by examiner

METAL HALIDE LAMP

The present invention relates to a lamp, in particular a metal halide lamp, comprising a discharge vessel surrounded by an outer envelope with clearance and having a ceramic wall which encloses a discharge space filled with a filling comprising an inert gas, such as xenon (Xe), and an ionizable salt, wherein in said discharge space two electrodes are arranged whose tips have a mutual interspacing (EA) so as to define a discharge path between them.

In this description and these claims the ceramic wall is understood to mean both a wall of metal oxide such as, for example, sapphire or densely sintered polycrystalline $Al_2O_3$ and metal nitride, for example, AlN. According to the state of the art these ceramics are well suited to form translucent discharge vessel walls.

Such a lamp is generally known. Both electrodes are each supported by a current conductor entering the discharge vessel. The current conductors consist of a first part made of an halide resistant material, such as a Mo—$Al_2O_3$ cermet, and a second part made of niobium. Niobium is chosen because this material has a coefficient of thermal expansion corresponding to that of the discharge vessel in order to prevent leakage of the headlamp.

Disadvantages of the known lamp are the following. A central part of the discharge vessel thereof has on both sides narrow end parts or extended plugs (i.e. elongated end parts) that are connected by way of sintering to the central part of the discharge vessel and that enclose the current conductors. However, as said plugs are remote from the discharge path, they function as cooling fins, so that part of the lamp filling (i.e. salts) may condense in a void between each current conductor and the (wall of the) extended plugs. Said condensation may lead to color instability of the headlamp. Demixing of salt components generally leads to color instabilities (for example, if the filling contains NaCe-iodide, more Na than Ce will creep into said voids). In order to obtain a light efficacy as high as possible, preferably rare earth metal iodides as $CeI_3$, $PrI_3$, $LuI_3$ and/or $NdI_3$ are added to the filling. However, these salts (especially if larger mole fractions are applied) are aggressive and will attack the ceramic wall of the discharge vessel. Further, said wall attack—close to the discharge path—may lead to scattering/absorbing of light with all negative consequences involved for the light distribution. Finally, the light output as function of time should be as stable as possible. If salt reacts with other lamp parts and thus disappears, for example, said light output (and thus maintenance) will drop.

From WO 99/53522 and WO 99/53523 metal halide lamps are known which posses an improved lumen maintenance due to the existence of a W-halide cycle during lamp operation. The W-halide cycle which itself is of very complex nature and for which the presence of Ca in the filling is imperative, causes that tungsten evaporated from the hot tips of the electrodes is deposited back on parts of the electrodes being somewhat cooler, instead of deposition on the wall of the discharge vessel. Thus the W-halide cycle counteracts wall blackening. The known lamps have however a relative modest lumen output.

It is an object of the invention to obviate these disadvantages, particularly to propose a metal halide lamp operating in such a way that said corrosion of the (wall of the) extended plugs and said color instability is avoided.

In order to accomplish that objective a lamp of the type referred to in the introduction according to the invention is characterized in that said ionizable salt comprises NaI, TlI, $CaI_2$ and X-iodide, wherein X is one or more elements selected from the group comprising rare earth metals. Thus X can be formed by a single element or by a mixture of two or more elements. Preferably, X is selected from the group comprising Sc, Y, La, Ce, Pr, Gd, Tb, Dy, Ho, Er, Tm, Yb, Lu, Nd. More preferably, X is selected from the group comprising Ce, Pr, Nd, that is cerium, praseodymium and neodymium. Extensive research has surprisingly shown that salts comprising NaI, TlI, $CaI_2$ and X-iodide are non-aggressive and only slightly sensitive for large variations in lamp power and thus in coldest spot temperature, for example at the location of the voids mentioned above, and these salts exhibit relatively less tendency to segregation, i.e. changes in salt mix ratio at the coldest spot due to for instance corrosion or transport of said salts, and thus making the lamp relatively insensitive for performing color shifts due to segregation. For completeness' sake it is noted that Na, Tl, Ca and I stand for natrium, thallium, calcium and iodine, respectively.

In a preferred embodiment of a lamp in accordance with the invention X being the total amount of rare earth, the molar percentage ratio X-iodide/(NaI+TlI+$CaI_2$+X-iodide) lies above 0% up to maximum 10%, in particular between 0.5 and 7%, more in particular between 1 and 6. For a too low amount of X experiments have learned that the electrodes reach too high values of temperature to operate satisfactory. With amounts of X above the indicated maximum it turns out that it is impossible to maintain a W-halide cycles in the discharge vessel during lamp operation.

Preferably, X being the total amount of rare earth, the molar percentage ratio $CaI_2$/(NaI+TlI+$CaI_2$+X-iodide) lies between 10 and 95%. When the amount of $CaI_2$ is chosen outside the indicated range the W-halide cycles will not properly develop in the discharge vessel during lamp operation.

In another preferred embodiment of a lamp according to the invention the amount of NaI, TlI, $CaI_2$ and X-iodide lies between 0.001 and 0.5 g/$cm^3$, in particular between 0.025 and 0.3 g/$cm^3$. The volume of the discharge vessel particularly ranges between 0.008 and 2.5 $cm^3$.

In a preferred embodiment of a lamp in accordance with the invention the filling comprises mercury (Hg). In an alternative, the lamp filling is mercury-free.

To have a lamp which during its stable nominal operation emits light having a color temperature $T_c$ above 3500K the filling of a preferred embodiment of the lamp according to the invention also comprises a halide selected from Mn and Ir. Experiments have learnt that with the addition of a halide of Mn and Ir the color point in the color triangle having X,Y coordinates, of the light emitted by the lamp can be adjusted primarily along the X-axis of the color triangle. Varying of the amount of Tl halide in the filling has a major impact on adjustment along the Y-axis. Stable nominal operation means in this respect that the lamp is operated at a power and voltage for which it is designed. The designed power of the lamp is called the nominal power.

As to provide the required circumstances during nominal operation of the lamp for maintaining a proper W-halide cycle, the temperature of the wall of the discharge lamp needs to be at a minimum level. According to experiments this requirement is preferably fulfilled if the lamp has a wall load of at least 30 W/$cm^2$ during stable nominal operation. Wall load as herein defined is the ratio of the lamp power over the discharge vessel's internal wall surface measured over the electrode distance EA.

Otherwise the heat generated by the electrode is preferably used to keep the end parts of the discharge vessel at least at a required temperature level during lamp operation. One aspect is the required level necessary for a proper W-halide cycle. A further aspect is defining the coldest spot temperature for those filling components, which are saturated during steady lamp operation. In that respect a preferred lamp according to the invention has at least one electrode extending inside the discharge vessel over a length forming an electrode tip to bottom distance (t-b) between the discharge vessel wall and the electrode tip, which the tip to bottom distance (t-b) is at most 4.5 mm. In particular for a lamp according to the invention having a discharge vessel with a rectangular cross section along the discharge path the t-b is preferably at most 3.5 mm. Preferably each electrode fulfils the t-b requirement as a very effective means in designing a lamp with a universal burning-position. A further increase of the tip to bottom distance will result in a strong reduction of the luminous efficacy of the lamp. Also it will generally result in a drop in the resulting color rendering of the light emitted by the lamp, which make the lamp unsuitable for its specific application.

The electrode tip will resume during steady operation a relative low value due to the presence of X, preferably the presence of Sc, Y, La, Ce, Pr, Gd, Tb, Dy, Ho, Er, Tm, Yb, Lu or Nd, more preferably of Ce, Pr or Nd. Consequently advantageous reduction of the t-b is achieved, improving the heat balance control and thus the temperature of the discharge vessel's wall near the electrodes. It also advantageous promotes miniaturization of the discharge vessel as a whole.

The invention also relates to a metal halide lamp to be used in a vehicle headlamp according to the invention.

Finally, the invention refers to a method for manufacturing a lamp in accordance with the invention, wherein the lamp comprising a discharge vessel surrounded by an outer envelope with clearance and having a ceramic wall which encloses a discharge space filled with a filling comprising an inert gas, such as xenon (Xe), and an ionizable salt, wherein in said discharge space two electrodes are arranged whose tips have a mutual interspacing so as to define a discharge path between them, characterized in that said ionizable salt comprises NaI, TlI, $CaI_2$ and X-iodide, wherein X is selected from the group comprising rare earth metals.

The invention will now be explained in more detail with reference to Figs. illustrated in a drawing, wherein.

Figure 3:
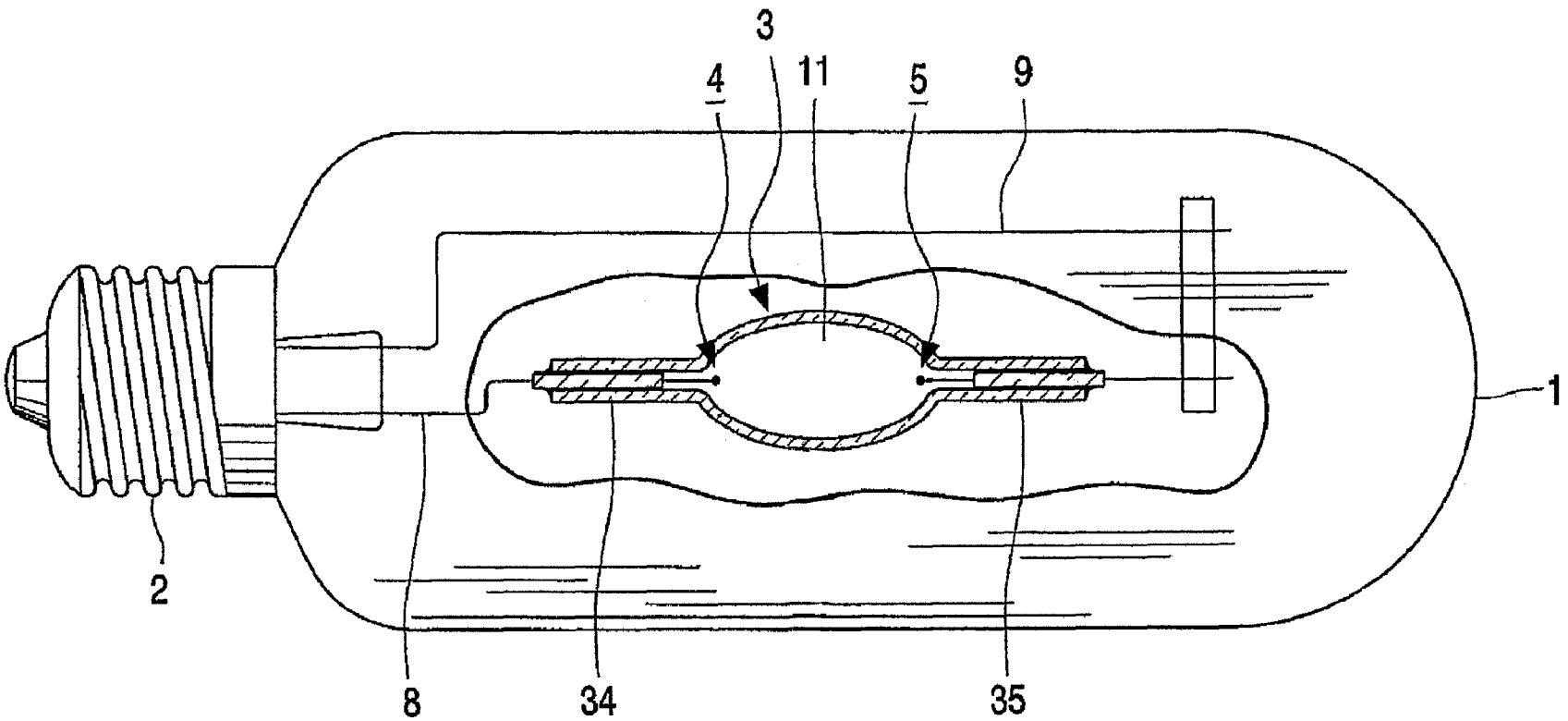

FIG. 3. shows a further preferred embodiment having a shaped discharge vessel.

Figure 1:
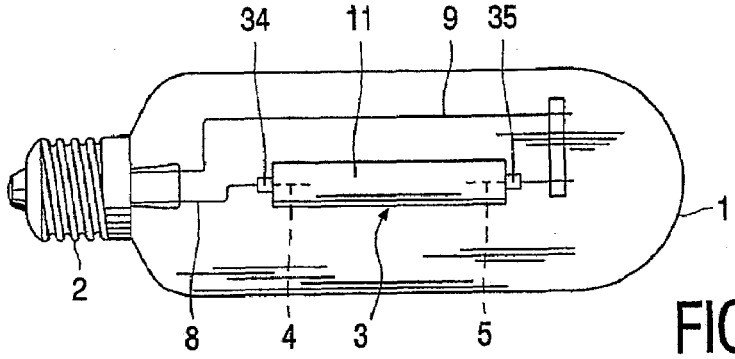
FIG. 1 shows a preferred embodiment of a lamp according to the invention in a side elevation.
Figure 2:
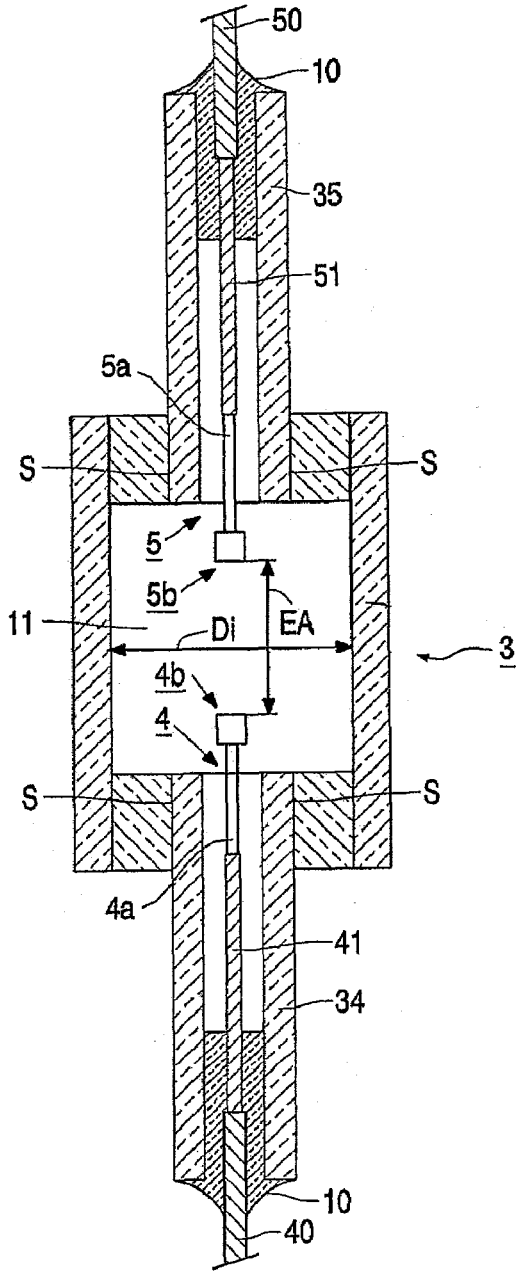
FIG. 2 shows the discharge vessel of the lamp of FIG. 1 in detail.

FIG. 1 shows a metal halide lamp provided with a discharge vessel 3 having a ceramic wall which encloses a discharge space 11 containing an ionizable filling. Two tungsten electrodes 4, 5 with tips 4*b*, 5*b* at a mutual distance EA are arranged in the discharge space, so as to define a discharge path between them. The discharge vessel has an internal diameter Di at least over the distance EA. Each electrode 4, 5 extends inside the discharge vessel 3 over a length forming a tip to bottom distance (FIG. 2: t-b) between the discharge vessel wall and the electrode tip 4*b*, 5*b*. The discharge vessel is closed at one side by means of a ceramic protruding plug 34, 35 which encloses a current lead-through conductor (FIG. 2: 40,41,50,51) to an electrode 4,5 positioned in the discharge vessel with a narrow intervening space and is connected to this conductor in a gas tight manner by means of a melting-ceramic joint (FIG. 2: 10) at an end remote from the discharge space. The discharge vessel is surrounded by an outer bulb 1 which is provided with a lamp cap 2 at one end. A discharge will extend between the electrodes 4,5 when the lamp is operating. The electrode 4 is connected to a first electrical contact forming part of the lamp cap 2 via a current conductor 8. The electrode 5 is connected to a second electrical contact forming part of the lamp cap 2 via a current conductor 9. The discharge vessel, shown in more detail in FIG. 2 (not true to scale), has a ceramic wall and is formed from a cylindrical part with an internal diameter Di which is bounded at either end by a respective ceramic protruding plug 34,35 which is fastened in a gas tight manner in the cylindrical part by means of a sintered joint S. The ceramic protruding plugs 34,35 each narrowly enclose a current lead-through conductor 40,41,50, 51 of a relevant electrode 4,5 having a tip 4*b*, 5*b*. The current lead-through conductor is connected to the ceramic protruding plug 34,35 in a gas tight manner by means of a melting-ceramic joint 10 at the side remote from the discharge space. The electrode tips 4*b*, 5*b* are arranged at a mutual distance EA. The current lead-through conductors each comprise a halide-resistant portion 41,51, for example in the form of a Mo—$Al_2O_3$ cermet and a portion 40,50 which is fastened to a respective end plug 34,35 in a gas tight manner by means of the melting-ceramic joint 10. The melting-ceramic joint extends over some distance, for example approximately 1 mm, over the Mo cermet 40,41. It is possible for the parts 41,51 to be formed in an alternative manner instead of from a Mo—$Al_2O_3$ cermet. Other possible constructions are known, for example, from EP 0 587 238. A particularly suitable construction was found to be a halide-resistant material. The parts 40,50 are made from a metal whose coefficient of expansion corresponds very well to that of the end plugs. Nb, for example, is for this purpose a highly suitable material. The parts 40,50 are connected to the current conductors 8,9 in a manner not shown in any detail. Each of the electrodes 4,5 comprises an electrode rod 4*a*,5*a* which is provided with a tip 4*b*,5*b*.

In FIG. 3 (not to scale) a further preferred embodiment of the lamp according to the invention is shown. Lamp parts corresponding with those shown in FIGS. 1 and 2 have been provided with the same reference numerals. The discharge vessel 3 has a shaped wall 2 enclosing the discharge space 11. In the shown case the shaped wall forms an ellipsoid. Alternatively, other shapes like for instance spheroid is equally possible.

In a practical realization of the lamp as represented in the drawing a number of lamps were manufactured with a rated power of 30 W each. The lamps are for use as headlamps for a motor vehicle. The ionizable filling of the discharge vessel 3 of each individual lamp comprises 100 mg/cm3 iodide, comprising NaI, TlI, CaI2 and CeI3. The filling further comprises Xe with a filling pressure at room temperature of 16 bar. The distance EA between the electrode tips 4*a*,5*a* is 4 mm, the internal diameter Di is 1.3 mm, so that the ratio EA/Di=3.1. The tip to bottom distance t-b for each electrode is 1 mm. The wall thickness of the discharge vessel 3 is 0.4 mm. The described lamp has in stable operation at rated power wall load of 184 W/cm2. Wall load is herein defined as the ratio of the lamp power over the discharge vessel's internal wall surface measured over the electrode distance EA. A large number of lamp embodiments according to the invention have been made and tested. In a first series lamps have been tested having a cylindrical discharge vessel with an internal diameter Di of 4 mm and with a filling comprising besides mercury and xenon 71.4 mol % NaI, 2.4 mol % TlI, 23.6 mol % CaI2 and 2.7 mol % CeI3. Lamp properties and test results are listed below.

TABLE I

| Lamp no. | Nominal Power (W) | EA (mm) | t-b (mm) | Wall load (W/cm2) | Luminous efficacy (lm/W) | Color temperature $T_c$ (K) | Lifetime (h) | Lumen Maintenance (%) |
|---|---|---|---|---|---|---|---|---|
| 1 | 72 | 18 | 0.5 | 32 | 124 | 2900 | | |
| 2 | 72 | 18 | 0.5 | 32 | 121 | 2900 | 5000 | 91 |
| 3 | 100 | 18 | 0.5 | 44 | 121 | 2900 | 1000 | 99 |
| 4 | 72 | 14 | 1.0 | 41 | 112 | 3000 | 500 | 99.5 |
| 5 | 72 | 15 | 0.5 | 38 | 118 | 2800 | | |
| 6 | 72 | 17 | 1.0 | 34 | 113 | 2900 | | |
| 7 | 100 | 17 | 1.0 | 47 | 122 | 3100 | 3000 | 96 |
| 8 | 110 | 17 | 1.0 | 51 | 131 | 3000 | | |
| 9 | 152 | 23 | 1.0 | 53 | 129 | 3100 | 1000 | 98 |

The values in the columns titled "Luminous efficacy" and "Color temperature $T_c$" concern the results after the lamp had been operated for 100 hours. The lumen maintenance in % stated in the last column is related to the stated lifetime in the column "Life time".

From the results shown in the Table I it is clear that the invention results in a lamp with a long and stable light output. During the life time of the lamps there occurred no significant change in the color properties of the emitted light.

In Table II main data of a further series of embodiments are given.

TABLE II

| Lamp no. | Nominal power (W) | Internal diameter Di (mm) | t-b (mm) | Wall Load (W/cm$^2$) | Salt mix Na/Tl/Ca/Ce-iodide (mol %) | Luminous efficacy (lm/W) at 100 h | Color temperature $T_c$ (K) at 100 h | Life time (h) | Maintenance (%) |
|---|---|---|---|---|---|---|---|---|---|
| 10 | 100.6 | 6.85 | 1.0 | 67 | 71/2.5/23.5/3 | 99.1 | 2953 | 3000 | 96.3 |
| 11 | 71.8 | 5.6 | 0.5 | 58 | 71/2.5/23.5/3 | 101.6 | 3081 | 3000 | 104.4 |
| 12 | 71.6 | 6.85 | 1.0 | 48 | 68.7/2.8/27.6/1 | 99.9 | 3038 | 5000 | 97.3 |
| 13 | 71.5 | 6.85 | 1.0 | 47 | 74.1/2.2/22.2/3.3 | 101.2 | 3386 | 5000 | 93.4 |

For the lamps nr. 10 to 13 the electrode distance EA is 7 mm. Over the life time as listed of the lamps in Table II they did not display any significant change in the color properties of the emitted light.

Also a number of high wattage lamps have been made and tested. These lamps had a nominal power of 400 W and were provided with a cylindrical discharge vessel. The main data are listed in Table III.

TABLE III

| Lamp no | Di (mm) | EA (mm) | t-b (mm) | Wall Load (W/cm2) | Salt mix iodide (mol %) | Luminous efficacy (lm/W) at 100 h | Color temperature $T_c$ (K) at 100 h | Life time (h) | Maintenance (%) |
|---|---|---|---|---|---|---|---|---|---|
| 14 | 12 | 15 | 3.0 | 71 | Na/Tl/Ca/Ce 48/3/48/1 | 112 | 3000 | 5000 | 90 |
| 15 | 12 | 12 | 3.0 | 88 | Na/Tl/Ca/Ce 4/3/92/1 | 101 | 4000 | 5000 | 85 |
| 16 | 10 | 28 | 2.0 | 45 | Na/Tl/Ca/Mn/Ce 35/3/35/25/1 | 96 | 4100 | 500 | 99 |
| 17 | 10 | 28 | 2.0 | 45 | Na/Tl/Ca/Ce 48/3/48/1 | 100 | 3800 | 1000 | 96 |

In lamp nr. 17 the filling comprised additionally 0.25 mg InI. The volume of the discharge vessel ranged from 2.1 mm$^3$ for lamp nr. 15 to 2.4 mm$^3$ for the other lamps. All lamps showed very stable color properties over the listed life time.

Data and results of further embodiments according to the invention, which are specifically intended for general lighting, are listed below.

| | | |
|---|---|---|
| Nominal power (W) | 60 | 140 |
| Discharge vessel volume (mm$^3$) | 163.6 | 573.6 |
| Internal diameter discharge vessel Di (mm) | 3.5 | 5.3 |
| Electrode distance EA (mm) | 15.4 | 23 |

-continued

| | | |
|---|---|---|
| Electrode tip-to-bottom distance t-b (mm) | 0.8 | 1.5 |
| Mercury amount (mg) | 1 | 2.5 |
| Salt amount (mg) | ≈7 | ≈15 |
| NaI (mol %) | 74.1 | 79.8 |
| TlI (mol %) | 0.8 | 0.7 |

-continued

| | | |
|---|---|---|
| $CaI_2$ (mol %) | 22.6 | 17.5 |
| $CeI_3$ (mol %) | 2.5 | 2.0 |
| Luminous efficacy at: | | |
| 100 h (lm/W) | 114 | 122 |
| 1000 h (lm/W) | 112 | 122 |
| color temperature $T_C$ (K) at: | | |
| 100 h | 2860 | 2840 |
| 1000 h | 2910 | 2955 |

The invention claimed is:

1. A metal halide lamp comprising a discharge vessel surrounded by an outer envelope with clearance and having a ceramic wall which encloses a discharge space filled with a filling comprising an inert gas including xenon (Xe), and an ionizable salt, wherein in said discharge space two electrodes are arranged having electrode tips with a mutual interspacing EA so as to define a discharge path between the electrode tips, wherein said ionizable salt comprises NaI, TlI, $CaI_2$ and X-iodide, wherein X comprises rare earth metals including Nd, and wherein a molar percentage ratio X-iodide/(NaI+TlI+CaI2+X-iodide) is between 0.5% and 3%.

2. The metal halide lamp according to claim 1, wherein X is one or more elements selected from the group comprising Sc, Y, La, Ce, Pr, Gd, Tb, Dy, Ho, Er, Tm, Yb, Lu, Nd.

3. The metal halide lamp according to claim 1, wherein X is one or more elements selected from the group consisting of Ce, Pr, Nd.

4. The metal halide lamp according to claim 1, wherein the molar percentage ratio $CaI_2$/(NaI+TlI+$CaI_2$+X-iodide) lies between 10 and 95%.

5. The metal halide lamp according to claim 1, wherein the amount of NaI, TlI, $CaI_2$ and X-iodide lies between 0.001 and 0.5 g/$cm^3$.

6. The metal halide lamp according to claim 1, emitting light during stable nominal operation having a color temperature $T_c$ above 3500K, wherein the filling of the discharge space also comprises a halide selected from Mn and In.

7. The metal halide lamp according to claim 1, wherein the filling comprises Hg.

8. The metal halide lamp according to claim 1, wherein the lamp has wall load when in stable operation at rated power of at least 30 W/$cm^2$.

9. The metal halide lamp according to claim 1, wherein at least one electrode extends inside the discharge vessel over a length forming a tip to bottom distance (t-b) between the discharge vessel wall and the electrode tip and which the tip to bottom distance (t-b) is greater than 4.0 mm and at most 4.5 mm.

10. The metal halide lamp according to claim 1, wherein the discharge vessel has a rectangular cross section along the discharge path and wherein the tip to bottom distance (t-b) is at most 3.5 mm.

11. The metal halide lamp according to claim 1, wherein the filling of the discharge space is free of Cs.

12. The metal halide lamp of claim 1 to be used in a vehicle headlamp.

13. The metal halide lamp of claim 1, wherein the filling is mercury-free.

14. The metal halide lamp of claim 1, wherein a ratio between the mutual interspacing EA between the electrode tips and an internal diameter Di of the discharge vessel EA/Di=3.1.

15. The metal halide lamp of claim 1, wherein the mutual interspacing EA is substantially 4 mm, and an internal diameter Di of the discharge vessel is substantially 1.3 mm.

16. A method for manufacturing a vehicle headlamp, said method comprising the acts of:

providing the vehicle headlamp with a metal halide lamp comprising a discharge vessel;

surrounding said discharge vessel with an outer envelope with clearance and having a ceramic wall which encloses a discharge space;

filling said discharge space with a filling comprising an inert gas including xenon (Xe), and an ionizable salt; and arranging in said discharge space two electrodes having electrodes tips with a mutual interspacing EA so as to define a discharge path between the electrodes tips;

wherein said ionizable salt comprises NaI, TlI, $CaI_2$ and X-iodide, wherein X comprises rare earth metals including Nd, and wherein a molar percentage ratio X-iodide/(NaI+TlI+CaI2+X-iodide) is between 0.5% and 3%.

17. The method of claim 16, wherein X is one or more elements selected from the group comprising consisting of Ce, Pr, Nd, and wherein at least one electrode of said two electrodes extends inside the discharge vessel over a length forming a tip to bottom distance (t-b) between the discharge vessel wall and the electrode tip, the tip to bottom distance (t-b) being greater than 4.0 mm and at most 4.5 mm.

18. The method of claim 16, wherein the filling is mercury-free.

19. The method of claim 16, wherein a ratio between the mutual interspacing EA between the electrode tips and an internal diameter Di of the discharge vessel EA/Di=3.1.

* * * * *